US007094041B2

(12) United States Patent
Hashimoto et al.

(10) Patent No.: US 7,094,041 B2
(45) Date of Patent: Aug. 22, 2006

(54) ELECTROMAGNETIC DRIVE TYPE PLUNGER PUMP

(75) Inventors: Shogo Hashimoto, Odawara (JP); Ryoji Ehara, Odawara (JP); Junichiro Takahashi, Odawara (JP)

(73) Assignee: Mikuni Corporation, Tokyo (JP)

( * ) Notice: Subject to any disclaimer, the term of this patent is extended or adjusted under 35 U.S.C. 154(b) by 295 days.

(21) Appl. No.: 10/398,807

(22) PCT Filed: Oct. 17, 2001

(86) PCT No.: PCT/JP01/09123

§ 371 (c)(1),
(2), (4) Date: Apr. 10, 2003

(87) PCT Pub. No.: WO02/33259

PCT Pub. Date: Apr. 25, 2002

(65) Prior Publication Data

US 2004/0022651 A1 Feb. 5, 2004

(30) Foreign Application Priority Data

Oct. 18, 2000 (JP) ..... 2000-317925

(51) Int. Cl.
*F04B 35/04* (2006.01)

(52) U.S. Cl. ..... 417/417

(58) Field of Classification Search ..... 417/416, 417/417

See application file for complete search history.

(56) References Cited

U.S. PATENT DOCUMENTS 3,588,291 A * 6/1971 Curwen ..... 417/417
3,849,031 A * 11/1974 Charboneau et al. ..... 417/417
4,101,950 A * 7/1978 Hager et al. ..... 361/203
4,150,924 A 4/1979 Toyoda
4,169,696 A * 10/1979 Brown ..... 417/417
4,343,597 A 8/1982 Brown
4,389,169 A * 6/1983 De Dionigi ..... 417/417
6,413,057 B1 * 7/2002 Hong et al. ..... 417/416
6,942,470 B1 * 9/2005 Versini ..... 417/417
2003/0017064 A1 * 1/2003 Kawahara et al. ..... 417/417

FOREIGN PATENT DOCUMENTS

JP 57-97191 6/1982
JP 1-318768 12/1989

* cited by examiner

*Primary Examiner*—Charles G. Freay
(74) *Attorney, Agent, or Firm*—Wenderoth, Lind & Ponack, L.L.P.

(57) ABSTRACT

With structure comprising a cylinder, a magnetic circuit to exert a mountain-shaped thrust, and a feeding spring to exert an urging force to a plunger during a feeding process, fuel is sucked by movement of the plunger and energy is accumulated in the feeding spring during a powering state, the fuel is fed by movement of the plunger by the urging force of the feeding spring during a non-powering state, a spring constant of the feeding spring is set to generate an urging force larger than a thrust in an early range of the mountain-shaped thrust, and a second spring is disposed to exert an urging force in a direction against the urging force of the feeding spring to make the urging force smaller than the thrust, at least in the early range. In this manner, with an electromagnetically driven type plunger pump of a non-powering feeding type, an effective stroke is enlarged and a feeding amount is increased.

24 Claims, 8 Drawing Sheets

ELECTROMAGNETIC DRIVE TYPE PLUNGER PUMP

This application is a National Stage application of PCT/JP01/09123, filed Oct. 17, 2001.

TECHNICAL FIELD

The present invention relates to an electromagnetically driven type plunger pump, which sucks and feeds a liquid such as engine fuel and the like, and especially relates to an electromagnetically driven type plunger pump of a non-powering feed type, which sucks a liquid by movement of a plunger and accumulates energy in a spring during a powering state, and feeds the liquid with this accumulated energy during a non-powering state.

BACKGROUND ART

A conventional electromagnetically driven type plunger pump of a non-powering feed type comprises, for example, a plunger which is disposed in a cylinder (a cylindrical body) and being free to reciprocate, a pair of springs which exert specific urging force to the plunger from both ends thereof while having consistent contact therewith, a solenoid coil which exerts thrust (electromagnetic force) to the plunger to suck a liquid, a magnetic circuit including a yoke and various check valves.

The pair of springs is disposed to have consistent contact with the plunger, and dampen a vibration of the plunger while retaining it at a specific resting position during a non-powered resting state with energy of the springs released, or perform together as feeding springs to accumulate energy for feeding.

Further, as shown in FIG. 7, the thrust (electromagnetic force) generated by the magnetic circuit has a characteristic that it is maximum when plunger 3, which is urged by pair of springs 2, is located at the vicinity of yoke 1 which forms the magnetic circuit. In other words, this obtained thrust shows a mountain-shaped characteristic as being small in an early range and a later range, and being large in a middle range.

Additionally, as shown in FIG. 8, with the electromagnetically driven type plunger pump, a threshold F0, which is determined by a target discharging pressure (a feeding pressure) and a diameter (area) of the plunger, is present. Here, the plunger 3 cannot be moved towards a feeding direction when the urging force of spring 2 does not exceed the threshold F0.

On the other hand, as shown in FIG. 8 with a two-dot chain line, it is ideal to obtain an effective stroke Si as large as possible with spring constant ki of the spring 2 set relatively small, so that a feeding liquid amount (discharged amount) is increased with a moving stroke of the plunger 3 increased as large as possible. However, in this case, as shown in FIG. 8 with oblique lines, the urging force of the spring 2 exceeds the thrust in the early range. Consequently, even if power is supplied during a sucking process, the plunger 3 cannot be operated and compression of the spring 2, namely accumulation of the energy, is not performed.

Therefore, as shown in FIG. 8, when a liquid discharging pressure (feeding pressure) is set relatively high (200 kPa~300 kPa, for example), and also with restrictions of size of a product and the like, spring constant k of the spring 2 is set relatively large, resulting in that effective stroke S of the plunger 3 is small. Accordingly, a discharging amount (feeding amount) cannot be increased, and an increase of power consumption or upsizing of the solenoid coil is needed to obtain a necessary discharging amount.

The present invention is accomplished in the light of the above-mentioned points, and a purpose is to provide an electromagnetically driven type plunger pump which has a highly efficient discharging (feeding) performance with an effective stroke of the plunger being large, while being in a quest of simplifying structure, downsizing, reducing power consumption, reducing noise, and the like.

SUMMARY OF THE INVENTION

The electromagnetically driven type plunger pump of the present invention comprises a cylindrical body which forms a passage for a liquid, a plunger which is disposed having intimate contact in the passage of the cylindrical body being free to reciprocate within a specific range, a magnetic circuit including a solenoid coil which exerts a mountain-shaped thrust to the plunger in accordance with movement during a sucking process of the liquid, and a feeding spring which exerts an urging force against the plunger during a feeding process, wherein the liquid is sucked by movement of the plunger and energy is accumulated in the feeding spring during a powering state, the liquid is fed by movement of the plunger with energy released during a non-powering state, a spring constant of the feeding spring is set to generate an urging force which is larger than the thrust in an early range of the mountain-shaped thrust, and a second spring is disposed to exert an urging force against the plunger in a direction against the urging force of the feeding spring so that the urging force of the feeding spring is smaller than the thrust, at least in the early range.

With this structure, in the early range with relatively small thrust of mountain-shaped thrust characteristic curve, the urging force (load) of the feeding spring, which is set larger than the thrust (the spring constant is relatively small), is reduced to be smaller than the thrust by the urging force (load) of the second spring which urges in a direction against the feeding spring. The refore, the thrust can move the plunger in this early range, and a moving stroke of the plunger is enlarged, namely, energy accumulated in the feeding spring is increased, due to spring characteristics of the feeding spring and the second spring. Hence, a high efficient discharging (feeding) characteristic is obtained and a discharging amount (feeding amount) of the fuel is increased.

With the above-mentioned structure, the second spring can be disposed to have contact and to exert the urging force against the plunger at least in the early range, and to be apart from the plunger at least in ranges except for the early range.

With this structure, the second spring has contact and exerts the urging force against the plunger in the direction against the feeding spring at least in the early range, and only the urging force of the feeding spring is exerted to the plunger in a remainder of ranges. Therefore, compared with a case in which the second spring has consistent contact with the plunger, energy accumulated in the feeding spring can be increased.

With the above-mentioned structure, it is possible to set the second spring to be apart from the plunger when the second spring extends to a free length. With this structure, it is possible to make the structure simple, because the second spring leaves the plunger automatically when the second spring extends to the free length at which no urging force is generated.

With the above-mentioned structure, a spring constant of the second spring can be set larger than a spring constant of the feeding spring. With this structure, a desired urging force can be obtained with a compressed length shortened. Hence, the pump can be downsized.

With the above-mentioned structure, the second spring can be disposed at an opposite side of the feeding spring, sandwiching the plunger. With this structure, it is possible to reduce noise with a simple structure, because the plunger is supported from both sides by springs.

With the above-mentioned structure, the second spring can be disposed to surround the feeding spring at an outer side in a diametrical direction. With this structure, a compressed volume of when the plunger is at a full-stroke position can be reduced by a space for disposing of the second spring, and a compression rate of fuel to be fed is increased. In this manner, a self-absorption capability can be improved.

With the above-mentioned structure, it is possible for the plunger to have a liquid passage which pierces in an axial direction, and a valve body which is capable to open the liquid passage during a sucking process and to close the fuel passage during a feeding process, and the valve body is a poppet valve to perform an opening operation by moving outwardly. With this structure, because an outside area of the poppet valve is the space to be compressed, the compressed volume of when the plunger is at a full-stroke position can be reduced, and a compression rate of the fuel to be fed is increased, as mentioned above. In this manner, a self-absorption capability can be improved.

With the above-mentioned structure, the second spring can be a coil spring with a section thereof being rectangle-shaped (angular shape). With this structure, because a setting length of the second spring can be shortened, a compressed volume of when the plunger is at a full-stroke position can be reduced, and a compression rate of the fuel to be fed is increased. In this manner, a self-absorption capability can be improved.

BRIEF DISCRIPTION OF THE DRAWINGS

Figure 1:
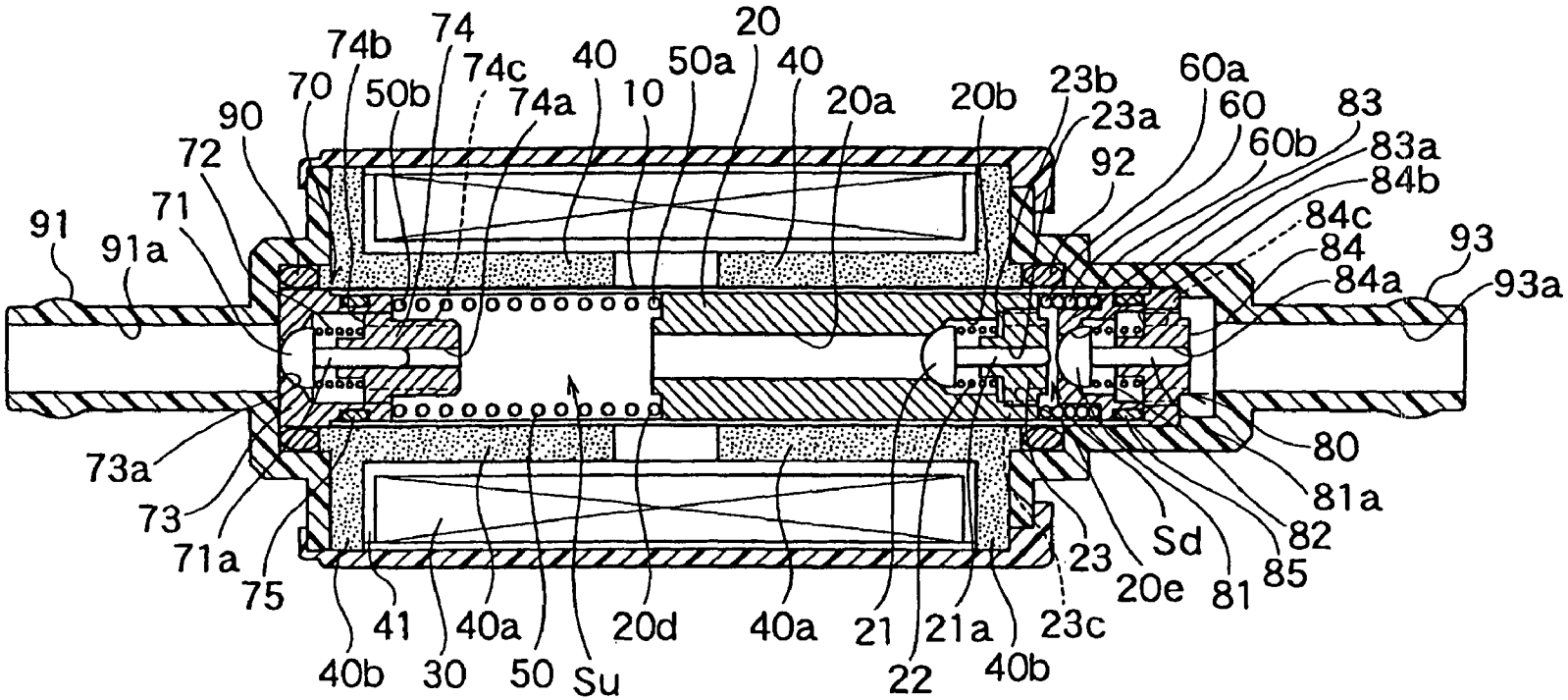
FIG. 1 is a sectional view showing an embodiment of an electromagnetically driven type plunger pump of the present invention.
Figure 3A:
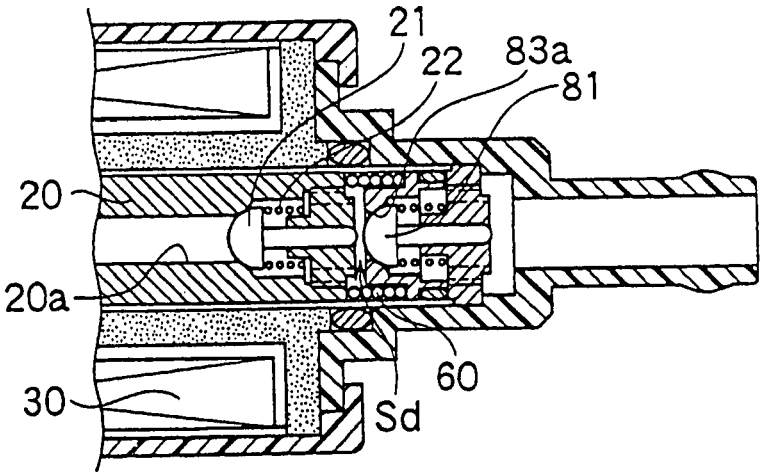
Figure 3B:
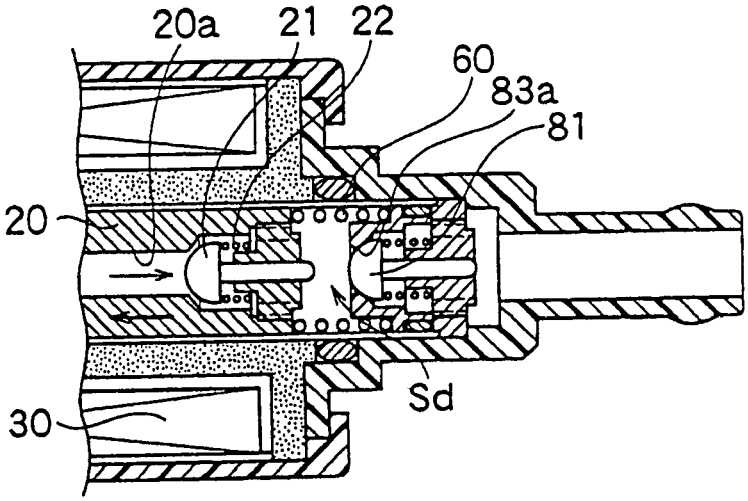
Figure 3C:
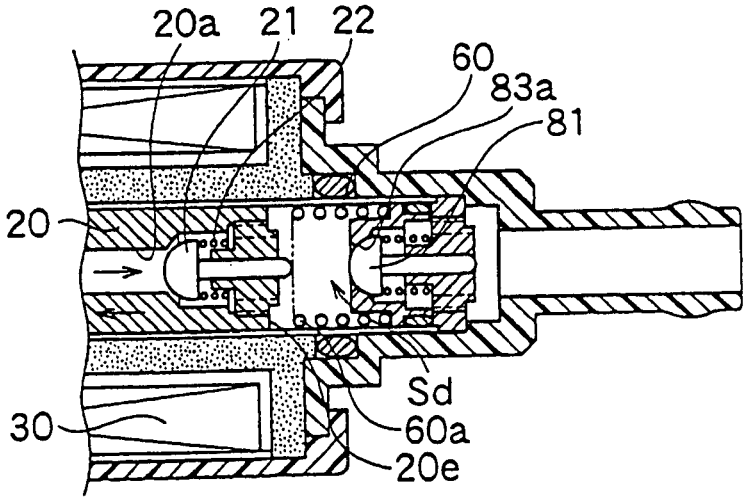

FIGS. 3(*a*)–3(*c*) are enlarged partial sectional views to explain operation of the electromagnetically driven type plunger pump shown in FIG. 1; wherein FIG. 3(*a*) shows a resting state, FIG. 3(*b*) shows a state of when a second spring extends to a free length, and FIG. 3(*c*) shows a state of when a plunger is apart from the second spring with further movement.

Figure 4:
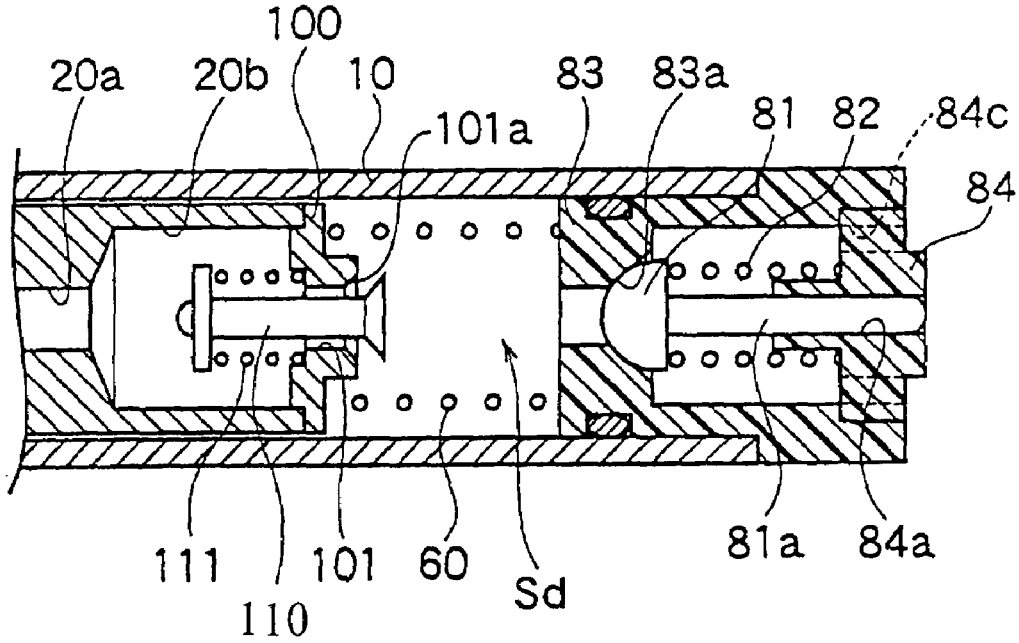

FIG. 4 is a partial sectional view showing another embodiment of the electromagnetically driven type plunger pump.

Figure 5:
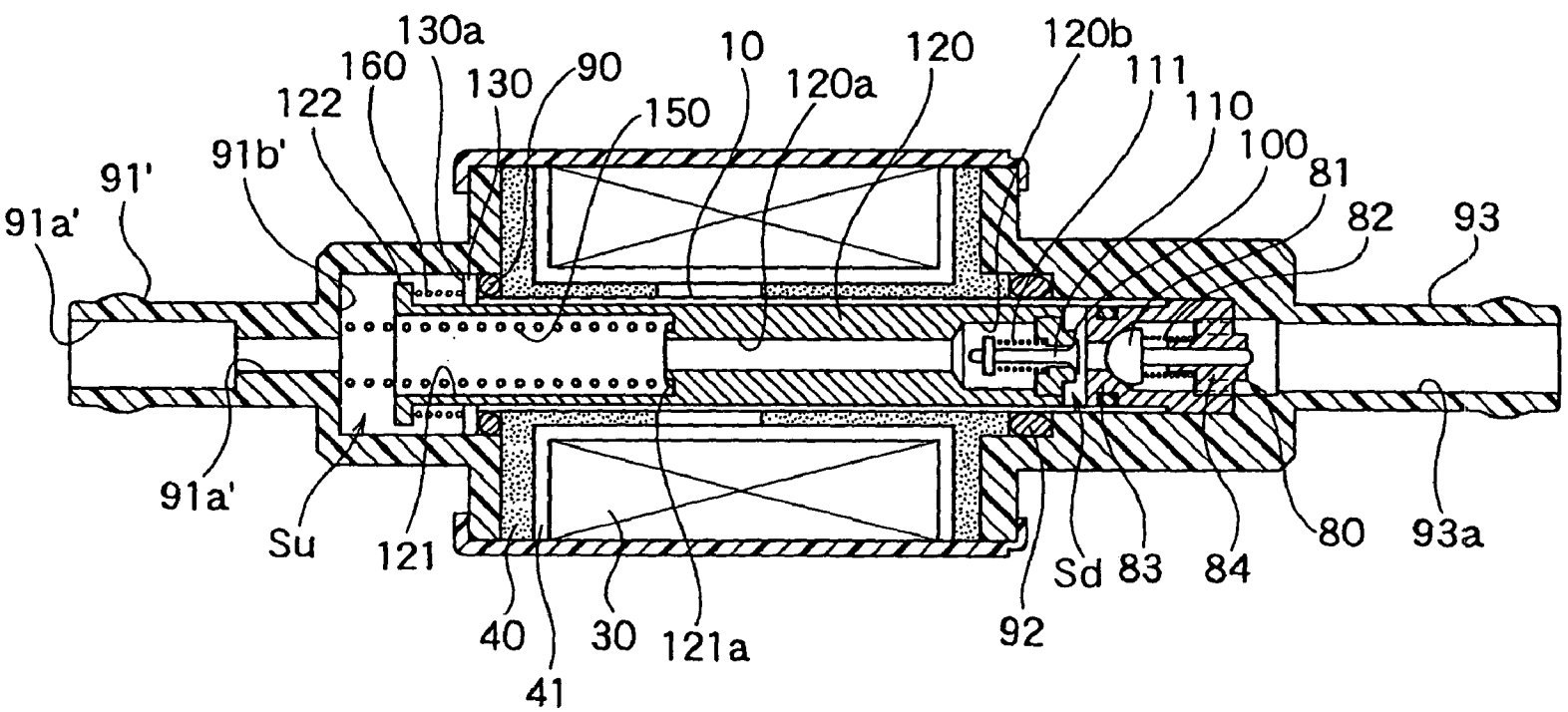

FIG. 5 is a sectional view further showing another embodiment of the electromagnetically driven type plunger pump.

Figure 6:
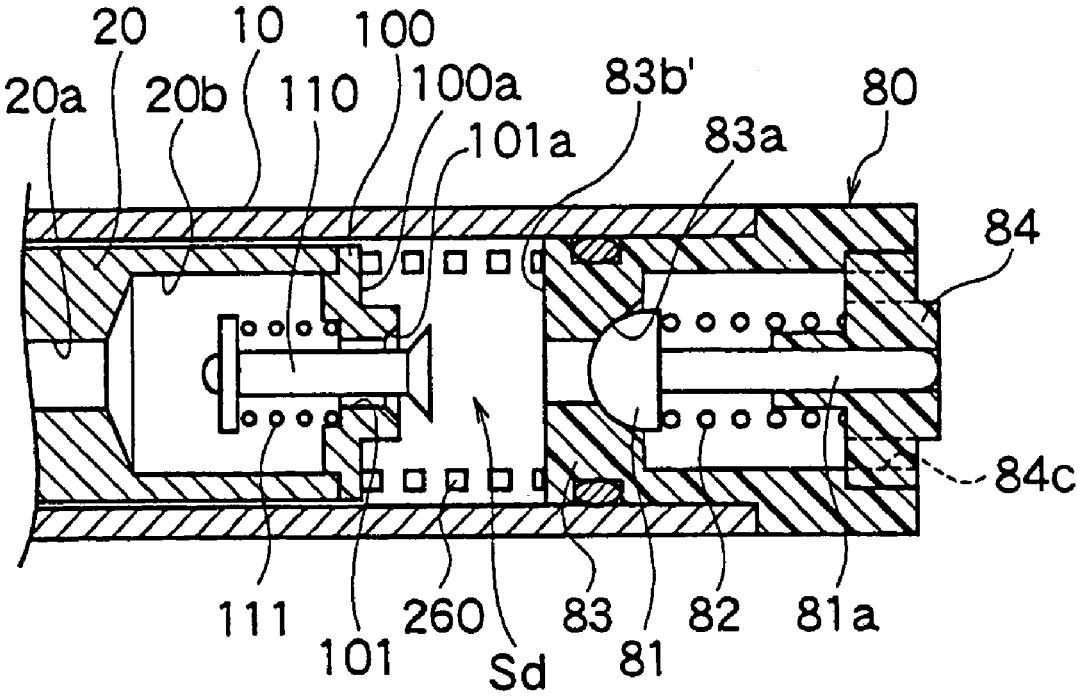

FIG. 6 is a partial sectional view further showing another embodiment of the electromagnetically driven type plunger pump.

Figure 7:
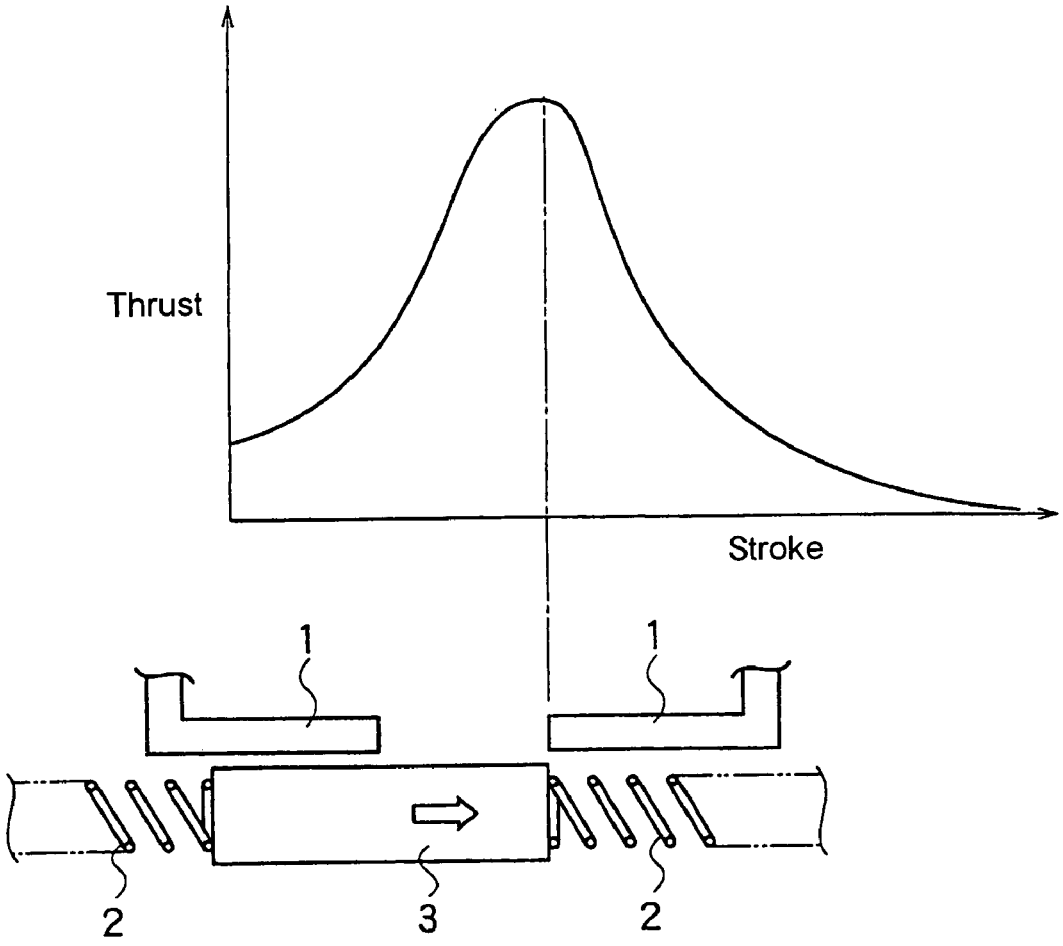

FIG. 7 is a diagram to explain mountain-shaped thrust.

Figure 8:
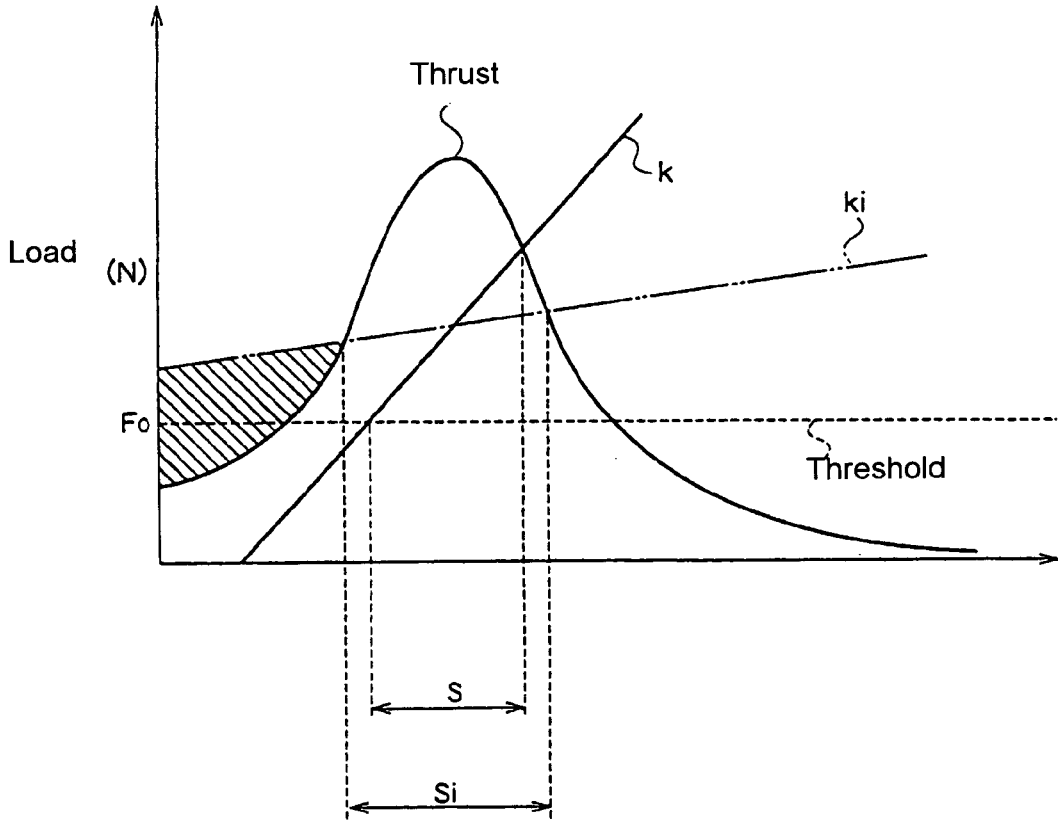

FIG. 8 is a characteristic diagram showing operating characteristics of the conventional electromagnetically driven type plunger pump.

DETAILED DESCRIPTION OF THE PREFERRED EMBODIMENTS

The embodiments of the present invention are explained in the following based on the attached drawings.

FIG. 1 is a sectional view showing an embodiment of an electromagnetically driven type plunger pump of the present invention. The electromagnetically driven type plunger pump of this embodiment feeds fuel for an engine and the like as a liquid. As shown in FIG. 1, the pump comprises a cylinder 10 as a cylindrical body whose shape is cylindrical, a plunger 20 disposed in a passage of the cylinder 10 and having intimate contact therewith and being free to reciprocate therein, a magnetic circuit including a solenoid coil 30 and a yoke 40 which generate electromagnetic force to exert thrust to the plunger 20, a feeding spring 50 which accumulates energy for feeding a liquid, and a second spring 60 which generates urging force in a direction against an urging force of the feeding spring 50, as a basic structure.

The plunger 20 is a movable member having a specific length, which slides in an axial direction in the cylinder 10 while being free to reciprocate within a specific range. A fuel passage 20*a* is formed in the plunger 20 as a liquid passage piercing in a reciprocating direction (the axial direction). Further, an enlarged passage 20*b* is formed at one end (a downstream side of fuel flow) as a liquid passage enlarging the fuel passage 20*a* in a diametrical direction.

A check valve 21 and a coil spring 22 which urges the check valve 21 towards an upstream side, namely towards the fuel passage 20*a*, are disposed in the enlarged passage 20*b*. A valve guide 23, which forms a part of the plunger 20 and has a guide passage 23*a* in a central portion thereof to guide a stem portion 21*a* of the check valve 21, is fitted to an outer end portion of the enlarged passage 20*b*. One end side of the coil spring 22 is held by an inner side end face 23*b* of the valve guide 23. Here, a fuel passage 23*c* is formed in the valve guide 23 at an outer side in a diametrical direction of the guide passage 23*a*.

Consequently, the fuel passage 20*a* of the plunger 20 is closed consistently with the check valve 21 which is urged by the coil spring 22. Then, when at least a specific pressure difference occurs between areas (the fuel passage 20*a* and the enlarged passage 20*b*) which sandwich the check valve 21 (pressure of the fuel passage 20*a* side>pressure of the enlarged passage 20*b* side), the check valve 21 opens the fuel passage 20*a*. Here, not limited to being hemisphere-shaped as shown in FIG. 1, the check valve 21 can also be sphere-shaped or disc-shaped. Furthermore, material of the check valve can be a resin such as rubber and the like, or metal.

A pair of ring-shaped yokes 40, which consist of a cylindrical portion 40*a* and a rim portion 40*b*, are disposed respectively with a specific gap and facing each other, at an outer side of the cylinder 10. A bobbin 41 is attached to the cylindrical portions 40*a* of the yokes 40, and the solenoid coil 30, for exciting, is wound on the bobbin 41.

Figure 2:
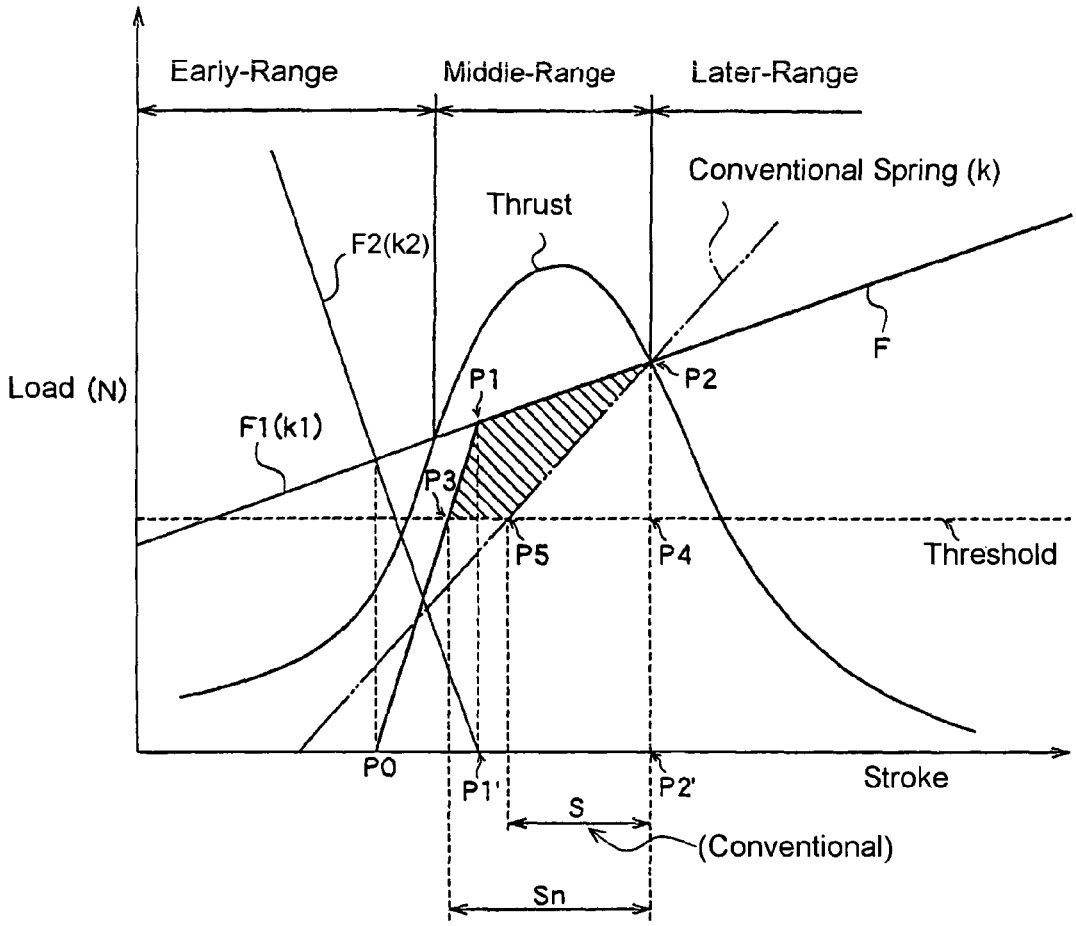
FIG. 2 is a characteristic diagram showing an operating characteristic of the electromagnetically driven type plunger pump shown in FIG. 1.

Then, by passing electric current through the solenoid coil 30 in a specific direction, magnetic force lines are generated passing through the pair of the yokes 40 and the plunger 20, and a thrust (electromagnetic force) to move the plunger 20 towards the left in FIG. 1 is generated. As shown in FIG. 2, a characteristic of the thrust forms a mountain-shaped curve in accordance with moving strokes of the plunger 20.

An inlet side valve support member 70 and an outlet side valve support member 80 are fixed by being fitted to both end portions of the cylinder 10, respectively. The feeding spring 50 is disposed between the inlet side valve support member 70 and one end portion of the plunger 20, and the second spring 60 is disposed between the outlet side valve support member 80 and another end portion of the plunger 20.

The inlet side valve support member 70 is formed with a valve case 73 which accommodates a check valve 71 and a coil spring 72, and has a fuel passage 73*a*, and a valve guide 74 which has a guide passage 74*a* to guide a stem portion 71*a* of the check valve 71. One end side of the coil spring 72 is held by an inner end face 74*b* of the valve guide 74. Here, the valve case 73 is fitted to the cylinder 10 with an O-ring 75. At the valve guide 74 which is fitted to the valve case 73, a fuel passage 74*c* is formed at an outer side in a diametrical direction of the guide passage 74*a*.

Consequently, the fuel passage 73*a* of the valve case 73 is closed consistently with the check valve 71 which is urged by the coil spring 72. Then, when at least a specific pressure difference occurs between chambers (an upstream side passage and a downstream side passage sandwiching the fuel passage 73*a*) which sandwich the check valve 71 (pressure of the upstream side>pressure of the downstream side), the check valve 71 opens the fuel passage 73*a*. Here, not limited to being hemisphere-shaped as shown in FIG. 1, the check valve 71 can also be sphere-shaped or disc-shaped. Furthermore, material of the check valve 71 can also be a resin such as rubber and the like, or metal.

The outlet side valve support member 80 is formed with a valve case 83 which accommodates a check valve 81 and a coil spring 82, and has a fuel passage 83*a*, and a valve guide 84 which has a guide passage 84*a* to guide a stem portion 81*a* of the check valve 81. One end side of the coil spring 82 is held by an inner end face 84*b* of the valve guide 84. Here, the valve case 83 is fitted to the cylinder 10 with an O-ring 85. At the valve guide 84 which is fitted to the valve case 83, a fuel passage 84*c* is formed at an outer side in a diametrical direction of the guide passage 84*a*.

Consequently, the fuel passage 83*a* of the valve case 83 is closed consistently with the check valve 81 which is urged by the coil spring 82. Then, when at least a specific pressure difference occurs between chambers (an upstream side passage and a downstream side passage sandwiching the fuel passage 83*a*) which sandwich the check valve 81 (pressure of the upstream side>pressure of the downstream side), the check valve 81 opens the fuel passage 83*a*. Here, not limited to being hemisphere-shaped as shown in FIG. 1, the check valve 71 can be sphere-shaped or disc-shaped. Furthermore, material of the check valve 71 can also be a resin such as rubber and the like, or metal.

Further, an inlet side connect pipe 91 is connected to an outer side of the inlet side valve support member 70 with an O-ring 90. The inlet side connect pipe 91 forms a fuel passage 91*a* piercing in an axial direction. Furthermore, an outlet side connect pipe 93 is connected so as to cover the outlet side valve support member 80 and the cylinder 10 with an O-ring 92. The outlet side connect pipe 93 forms a fuel passage 93*a* piercing in an axial direction.

The feeding spring 50 is a coil-shaped compression spring, and one end portion 50*a* has consistent contact with one end face 20*d* of the plunger 20, and another end portion 50*b* has consistent contact with the inner side end face 73*b* of the valve case 73. As shown in FIG. 2, the feeding spring 50 is set to have a relatively small spring constant k1, so that a generated urging force (load) F1 is larger than a thrust (load) in an early range and a later range which are the left side base part and the right side base part of the mountain-shaped thrust, respectively.

The second spring 60 is a coil-shaped compression spring. It is disposed and fixed so that one end portion 60*a* is free to be in contact with or apart from the other end face 20*e* of the plunger 20, and another end portion 60*b* is in contact with and not apart from a tubular groove bottom portion 83*b* of the valve case 83. As shown in FIG. 2, the second spring 60 is set to have a relatively large spring constant k2 (larger than the spring constant k1 of the feeding spring 50), so that urging force (load) F2 is exerted to the plunger 20 in a direction against the urging force F1 of the feeding spring 50 in the early range, which is the left side base of the mountain-shaped thrust, and in a part of a middle range.

Regarding performance of the second spring 60, because the urging force F2 directs against the urging force F1 of the feeding spring 50, it acts so as to eliminate the urging force of the feeding spring 50 in the above-mentioned specific range.

Therefore, resultant force F of the urging force F1 and the urging force F2 is zero (point P0) at a point of intersection of the urging force F1 line and the urging force F2 line. At a point where the urging force F2 of the second spring 60 is zero, only the urging force F1 of the feeding spring 50 remains (point P1). After this point, the resultant force traces the line of the urging force F1 of the feeding spring 50 passing through the intersection (point P2) with the thrust curve. Hence, it is a polygonal line as a whole.

In this manner, the urging force of the feeding spring 50 is smaller than the thrust as a result, in the early range where the urging force F1 of the feeding spring 50 is set larger than the thrust, so that the thrust can drive the plunger 20.

Further, moving stroke Sn of the plunger 20 is a distance between point P3, which is an intersection of the polygonal line indicating the resultant force F and threshold line, and point P4, which is an intersection between a perpendicular line passing through point P2 and threshold line, and is larger than conventional stroke S. Furthermore, compared with the conventional structure, effective energy which is accumulated in the feeding spring 50 is increased by an amount which corresponds to an area surrounded with points P1, P2, P5 and P3. Hence, a high efficient discharging (feeding) characteristic is obtained and a discharging amount (feeding amount) of fuel is increased relative to that of the conventional structure.

Next, operation of the electromagnetically driven type plunger pump of the abovementioned embodiment is explained in accordance with FIG. 1 through FIG. 3(*c*). First, the plunger 20 stays at a position (point P0) where the urging force of the feeding spring 50 and that of the second spring 60 balance at a non-powering state in which the solenoid coil 30 is not powered.

In this resting state, when the solenoid coil 30 is powered and an electromagnetic force (the thrust) is generated, the plunger 20 is pulled towards the upstream side (towards the left side in FIG. 1) to start a going movement. Upstream side chamber Su is reduced, and downstream side chamber Sd is expanded. At this time, as shown in FIG. 1 and FIG. 3(*a*), pressure in the downstream side chamber Sd decreases because the check valve 81 closes the fuel passage 83*a*. Then, when pressure in the upstream side chamber Su becomes larger than the pressure in the downstream side chamber Sd by a specific value, the check valve 21 opens the fuel passage 20*a* against the urging force of the coil spring 22. In this manner, fuel in the upstream side chamber Su is sucked into the downstream side chamber Sd passing through the fuel passage 20*a*.

Then, as shown in FIG. 2 and FIG. 3(*b*), when the plunger 20 moves a specific distance to reach point P1', the second spring 60 extends to a free length and exerts no urging force against the plunger 20. At the same time, only the urging force F1 of the feeding spring 50 starts to act as spring urging force applied to the plunger 20.

As shown in FIG. 3(*c*), when the plunger 20 moves further, the free end portion 60*a* of the second spring 60 is completely apart from the end face 20*e* of the plunger 20. Then, when the plunger reaches point P2' in FIG. 2, the thrust by the electromagnetic force and the urging force F1 of the feeding spring 50 balance (point P2), and the check valve 21 closes the fuel passage 20*a* at the same time when the plunger 20 stops. The above-mentioned movement (the going movement) of the plunger 20 corresponds to a sucking process of the fuel. During this sucking process, the feeding spring 50 is compressed so that energy of elastic deformation is accumulated.

Next, when powering to the solenoid coil 30 is cut off, thrust by the electromagnetic force is eliminated, and only the urging force F1 of the feeding spring 50, which is increased by compression, is exerted. As a result, the plunger 20 starts a returning movement towards the downstream side (towards the right side in FIG. 1). By this returning movement, the fuel sucked into the downstream side chamber Sd begins to be compressed. When it reaches a specific pressure, the check valve 81 opens the fuel passage 83*a* against the urging force of the coil spring 82. In this manner, the fuel filled in the downstream side chamber Sd is discharged (fed) through the outlet side connect pipe 93 at the specific pressure.

Meanwhile, as the upstream side chamber Su is expanded, when pressure of the upstream side chamber Su is decreased to be smaller than pressure of the fuel passage 91*a* in the inlet side connect pipe 91 by at least a specific value, the check valve 71 opens the fuel passage 73*a* against the urging force of the coil spring 72. In this manner, fuel upstream of the inlet side connect pipe 91 flows into the upstream side chamber Su through the fuel passage 73*a* to be ready for a next sucking process.

Here, the check valve 71 allows fuel at at least the specific pressure to flow into the upstream side chamber Su, and prevents the fuel from flowing back, so as to contribute to reducing a self-absorption time.

The above-mentioned movement (the returning movement) of the plunger 20 corresponds to a feeding process (a discharging process) of the fuel, and the movement is performed only by accumulated energy of the feeding spring 50. As shown in FIG. 2, during this feeding process, effective stroke Sn of the plunger 20 is larger than the conventional effective stroke S, and effective energy accumulated in the feeding spring 50 is also larger. Hence, a high efficient discharging (feeding) characteristic is obtained and a discharging amount (feeding amount) of fuel is increased relative to that of the conventional structure.

FIG. 4 shows another embodiment of the electromagnetically driven type plunger pump, with check valve 21 to open and close fuel passage 20*a* of plunger 20 being modified from the above-mentioned embodiment. Here, the same numerical notation is given to the same structure as the above-mentioned embodiment, and explanation of this structure is omitted.

With the electromagnetically driven type plunger pump of this embodiment, a valve seat member 100 is fitted to enlarged passage 20*b* of the plunger 20. As a valve body, a poppet valve 110 is disposed being free to reciprocate so as to seat on a seat surface 101*a* which is located at an end portion of a fuel passage 101 formed in the valve seat member 100. Further, a coil spring 111 is disposed to urge the poppet valve 110 to close the fuel passage 101 consistently.

With this structure, because the enlarged passage 20*b* and downstream side chamber Sd are disconnected during a fuel feeding process, a compression rate of the fuel is increased by a volume of the enlarged passage 20*b*. Hence, a self-absorption capability (self-priming) can be further improved.

FIG. 5 further shows another embodiment of the electromagnetically driven type plunger pump of the present invention. Compared with the above-mentioned embodiments shown in FIG. 1 and FIG. 4, a shape of plunger 20 and a disposed position of second spring 60 are changed. Here, the same numerical notation is given to the same structure as the above-mentioned embodiments, and explanation of this structure is omitted.

The electromagnetically driven type plunger pump of this embodiment comprises a plunger 120 which slides in cylinder 10 and includes a fuel passage 120*a* which extends in an axial direction, an enlarged passage 120*b* which is located at a downstream side of the fuel passage 120*a*, a spring hold portion 121 which is located at an upstream side of the fuel passage 120*a*, and a flange portion 122 which is located at an end portion of the upstream side.

Then, the poppet valve 110 and the coil spring 111, as shown in FIG. 4, are disposed in enlarged passage 120*b*. Outlet side valve support member 80, which supports check valve 81 and coil spring 82, is disposed at a downstream side. Outlet side connect pipe 93 is connected at a further downstream side.

A ring-shaped spring support member 130 is fitted to an upstream side end portion of the cylinder 10, and an inlet side connect pipe 91' is connected so as to fit to an outer circumference of the spring support member 130. Then, a feeding spring 150 is disposed in the spring hold portion 121 of the plunger 120. The feeding spring 150 is held with one end having contact with a bottom face 121*a* and another end having contact with an inner end face 91*b* of the inlet side connect pipe 91'.

Further, a second spring 160 is disposed between the spring support member 130 and the flange portion 122, at an outer circumferential area of the plunger 120. The second spring 160 is disposed so that one end is fixed to an end face 130*a* of the spring support member 130, and another end is free to be in contact with or apart from the flange portion 122.

The feeding spring 150 and the second spring 160 are set to have characteristics as shown in FIG. 2, and operations are the same as those of the above-mentioned embodiments.

With this structure, because the second spring 160 is disposed so as to surround the feeding spring 150 at an outer side in a diametrical direction, a volume of downstream side chamber Sd is decreased to a minimum when the plunger 120 is at a full-stroke position. In this manner, along with an advantage of the poppet valve 110, a compression rate of fuel is increased and a self-absorption capability can be further improved.

In addition, with this embodiment, as a check valve is not disposed at an inlet side of the upstream side chamber Su, the fuel passage 91*a'* and the upstream side chamber Su are consistently connected, and a remainder of operations is the same as that of the above-mentioned embodiments.

FIG. 6 further shows another embodiment of the electromagnetically driven type plunger pump of the present invention. Compared with the above-mentioned embodiment shown in FIG. 4, second spring 60 is modified. Here, the same numerical notation is given to the same structure as the above-mentioned embodiments, and explanation of this structure is omitted.

With the electromagnetically driven type plunger pump of this embodiment, a second spring 260 with a sectional shape being rectangular (angular shape) is disposed in downstream side chamber Sd which is located at a downstream side of plunger 20. The second spring 260 is a coil spring being set to have the same characteristic as that of the above-mentioned second spring 60. This second spring 60 is disposed so that one end is free to be in contact with or apart from an end face 100*a* of valve seat member 100 which supports poppet valve 110 and coil spring 111, and another end is fixed to an end face 83*b*' of valve case 83 which constitutes outlet side valve support member 80.

With this structure, because the second spring 260 is a coil spring with the section being rectangle-shaped, a compressed length can be shortened so that a volume of the downstream side chamber Sd is further reduced (decreased) when the plunger 20 is at a full-stroke position. In this manner, along with an advantage of the poppet valve 110, a compression rate of fuel is increased and a self-absorption capability (self-priming) can be further improved.

With the above-mentioned embodiments, the plunger, such as 20, 120, 220, in which a fuel passage is formed piercing in an axial direction, is adopted as an application of the present invention. However, not limited to this, it is certainly possible to apply the present invention, for example, to a type wherein the plunger is solid, with a going movement of the plunger sucking fuel into downstream side chamber Sd through a fuel passage formed at a side face of cylinder 10, and a returning movement of the plunger feeding fuel thereafter.

Furthermore, with above-mentioned embodiments, fuel for an engine and the like (gasoline, light oil) is handled as a liquid to be sucked and fed. However, not limited to this, it is possible to handle various liquids such as water, oil and the like, as long as it is a liquid.

INDUSTRIAL APPLICABILITY

As mentioned above, with an electromagnetically driven type plunger pump of the present invention, a spring constant of a feeding spring, which generates drive force for non-powering feeding (discharging), is set to generate an urging force which is larger than thrust in an early range of mountain-shaped thrust (electromagnetic force) in accordance with moving strokes of a plunger, and a second spring is disposed to exert an urging force against the plunger in a direction against the urging force of the feeding spring so that the urging force of the feeding spring is smaller than the thrust, at least in the early range. Because of this structure, the plunger can be moved by the thrust in this early range, and a moving stroke of the plunger and accumulated energy of the feeding spring are increased due to spring characteristics of the feeding spring and the second spring. In this manner, a high efficient discharging (feeding) characteristic is obtained and a discharging amount (feeding amount) of fuel is increased.

Further, the structure can be simplified by setting a position where exerting of the urging force of the second spring stops to be a position where the second spring extends to a free length.

Furthermore, by disposing the second spring at an outer side in a diametrical direction of the feeding spring, adopting a poppet valve as a valve body which is located at a downstream side of the plunger, or adopting a coil spring with a section being rectangle-shaped as the second spring, a compressed volume of when the plunger is at a full-stroke position can be reduced, and a compression rate of fuel to be fed is increased. In this manner, a self-absorption capability can be improved.

The invention claimed is:

1. An electromagnetically driven plunger pump, comprising:

a cylindrical body defining a passage for a liquid;

a plunger, having a passage extending therethrough, reciprocally disposed in said passage defined by said cylindrical body and having intimate contact therewith, said plunger being free to reciprocate within a specific range;

a feeding spring for exerting an urging force against said plunger in a first direction;

a first check valve for opening and closing said passage extending through said plunger;

a chamber on a downstream side of said first check valve;

a second check valve on a downstream side of said chamber;

a first spring for exerting an urging force against said second check valve for preventing flow of the fluid from said chamber;

a second spring, surrounding said feeding spring, for exerting an urging force against said plunger in a second direction opposite the first direction; and a magnetic circuit including a solenoid coil for applying a thrust to said plunger so as to move said plunger in the second direction, such that (i) when said magnetic circuit is activated, said plunger moves in the second direction so as to draw liquid into said chamber through said passage extending through said plunger and so as to accumulate energy in said feeding spring, and (ii) when said magnetic circuit is de-activated, accumulated energy in said feeding spring is released so as to move said plunger in the first direction and thereby discharge the liquid from said chamber.

2. The electromagnetically driven plunger pump according to claim 1, wherein said magnetic circuit is for applying a thrust to said plunger by applying a mountain-shaped thrust to said plunger, with said feeding spring having a spring constant such that the urging force exerted by said feeding spring against said plunger during an early range of application of the mountain-shaped thrust to said plunger is greater than a value of the mountain-shaped thrust at this time, and such that the urging force exerted by said feeding spring against said plunger during the early range of application of the mountain-shaped thrust to said plunger is less than a combination of the value of the mountain-shaped thrust and the urging force exerted by said second spring against said plunger at this time.

3. The electromagnetically driven plunger pump according to claim 2, wherein said second spring is disposed (i) to have contact with, and to exert the urging force against, said plunger at least during the early range of application of the mountain-shaped thrust to said plunger, and (ii) to be spaced from said plunger at least during ranges of application the mountain-shaped thrust to said plunger other than the early range of application.

4. The electromagnetically driven plunger pump according to claim 3, wherein said second spring is to be spaced from said plunger when said second spring extends to a free length.

5. The electromagnetically driven plunger pump according to claim 4, wherein a spring constant of said second spring is larger than the spring constant of said feeding spring.

6. The electromagnetically driven plunger pump according to claim 4, wherein said second spring is disposed on a side of said plunger that is opposite the side of said plunger on which said feeding spring is disposed, such that said plunger is sandwiched between said feeding spring and said second spring.

7. The electromagnetically driven plunger pump according to claim 4, wherein said first check valve comprises a poppet valve capable of opening said passage extending through said plunger by moving outwardly such that liquid is allowed to be drawn into said chamber, and capable of closing said fuel passage as said plunger moves in the first direction.

8. The electromagnetically driven plunger pump according to claim 4, wherein said second spring is a coil spring having a rectangle-shaped section.

9. The electromagnetically driven plunger pump according to claim 3, wherein a spring constant of said second spring is larger than the spring constant of said feeding spring.

10. The electromagnetically driven plunger pump according to claim 3, wherein said second spring is disposed on a side of said plunger that is opposite the side of said plunger on which said feeding spring is disposed, such that said plunger is sandwiched between said feeding spring and said second spring.

11. The electromagnetically driven plunger pump according to claim 3, wherein said first check valve comprises a poppet valve capable of opening said passage extending through said plunger by moving outwardly such that liquid is allowed to be drawn into said chamber, and capable of closing said fuel passage as said plunger moves in the first direction.

12. The electromagnetically driven plunger pump according to claim 3, wherein said second spring is a coil spring having a rectangle-shaped section.

13. The electromagnetically driven plunger pump according to claim 2, wherein a spring constant of said second spring is larger than the spring constant of said feeding spring.

14. The electromagnetically driven plunger pump according to claim 13, wherein said second spring is disposed on a side of said plunger that is opposite the side of said plunger on which said feeding spring is disposed, such that said plunger is sandwiched between said feeding spring and said second spring.

15. The electromagnetically driven plunger pump according to claim 13, wherein said first check valve comprises a poppet valve capable of opening said passage extending through said plunger by moving outwardly such that liquid is allowed to be drawn into said chamber, and capable of closing said fuel passage as said plunger moves in the first direction.

16. The electromagnetically driven plunger pump according to claim 13, wherein said second spring is a coil spring having a rectangle-shaped section.

17. The electromagnetically driven plunger pump according to claim 2, wherein said second spring is disposed on a side of said plunger that is opposite the side of said plunger on which said feeding spring is disposed, such that said plunger is sandwiched between said feeding spring and said second spring.

18. The electromagnetically driven plunger pump according to claim 17, wherein said first check valve comprises a poppet valve capable of opening said passage extending through said plunger by moving outwardly such that liquid is allowed to be drawn into said chamber, and capable of closing said fuel passage as said plunger moves in the first direction.

19. The electromagnetically driven plunger pump according to claim 17, wherein said second spring is a coil spring having a rectangle-shaped section.

20. The electromagnetically driven plunger pump according to claim 1, wherein said first check valve comprises a poppet valve capable of opening said passage extending through said plunger by moving outwardly such that liquid is allowed to be drawn into said chamber, and capable of closing said fuel passage as said plunger moves in the first direction.

21. The electromagnetically driven plunger pump according to claim 1, wherein said second spring is a coil spring having a rectangle-shaped section.

22. The electromagnetically driven plunger pump according to claim 2, wherein said first check valve comprises a poppet valve capable of opening said passage extending through said plunger by moving outwardly such that liquid is allowed to be drawn into said chamber, and capable of closing said fuel passage as said plunger moves in the first direction.

23. The electromagnetically driven plunger pump according to claim 22, wherein said second spring is a coil spring having a rectangle-shaped section.

24. The electromagnetically driven plunger pump according to claim 2, wherein said second spring is a coil spring having a rectangle-shaped section.

* * * * *